United States Patent [19]

Plewman

[11] Patent Number: 4,751,626

[45] Date of Patent: Jun. 14, 1988

[54] REFLECTOR SYSTEM FOR A LUMINAIRE

[75] Inventor: Dale Plewman, Spokane, Wash.

[73] Assignee: Columbia Lighting, Inc., Spokane, Wash.

[21] Appl. No.: 55,231

[22] Filed: May 28, 1987

[51] Int. Cl.[4] ..... F21V 7/12

[52] U.S. Cl. ..... 362/346; 362/342; 362/290; 362/217

[58] Field of Search ..... 362/217, 290, 342, 346

[56] References Cited

U.S. PATENT DOCUMENTS 3,246,138 4/1966 Florence ..... 362/217
3,591,798 7/1971 Florence ..... 362/225

FOREIGN PATENT DOCUMENTS 3034892 4/1982 Fed. Rep. of Germany ..... 362/342

OTHER PUBLICATIONS

Columbia Lighting Inc. brochure entitled "P3 Parabalume Luminaires", 20 pages, 10/1982.

*Primary Examiner*—Stephen F. Husar
*Attorney, Agent, or Firm*—Bielen & Peterson

[57] ABSTRACT

A reflector system for a luminaire having an electric lamp which includes a first reflector and a second reflector extending along opposite sides of the lamp. A cross baffle is located between the first and second reflectors and includes reflecting surfaces at the side portions. The cross baffles also includes a light absorbing portion at the top between the reflecting surfaces of the cross baffle to prevent bright spots in the luminaire.

7 Claims, 2 Drawing Sheets

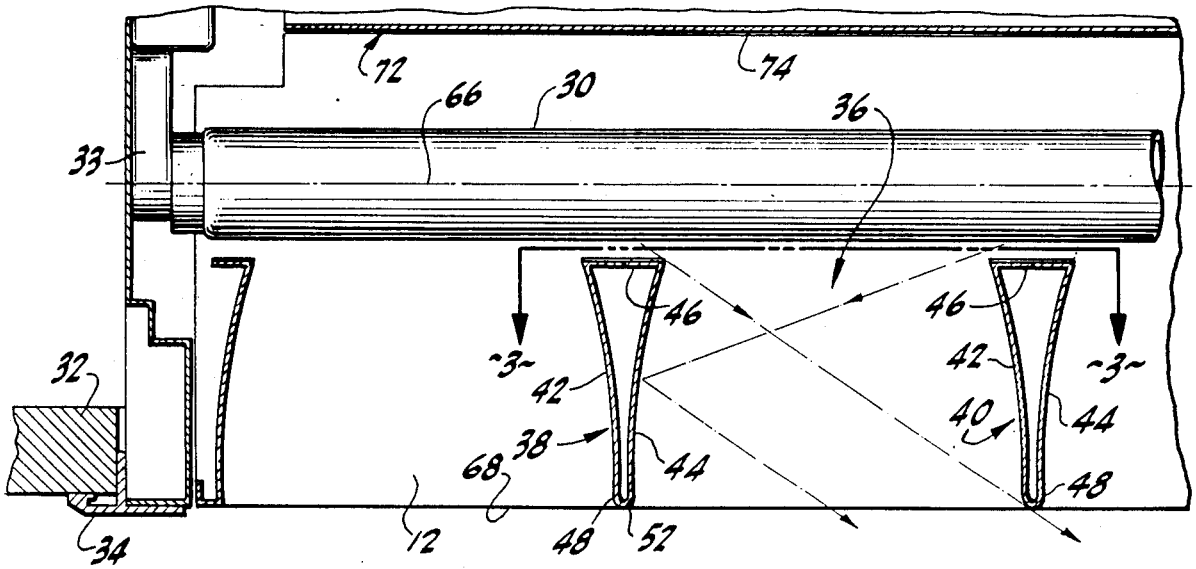
FIG-2
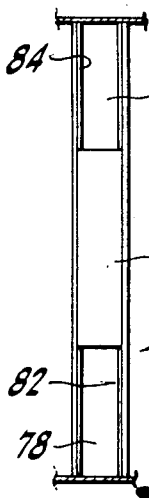
FIG-5
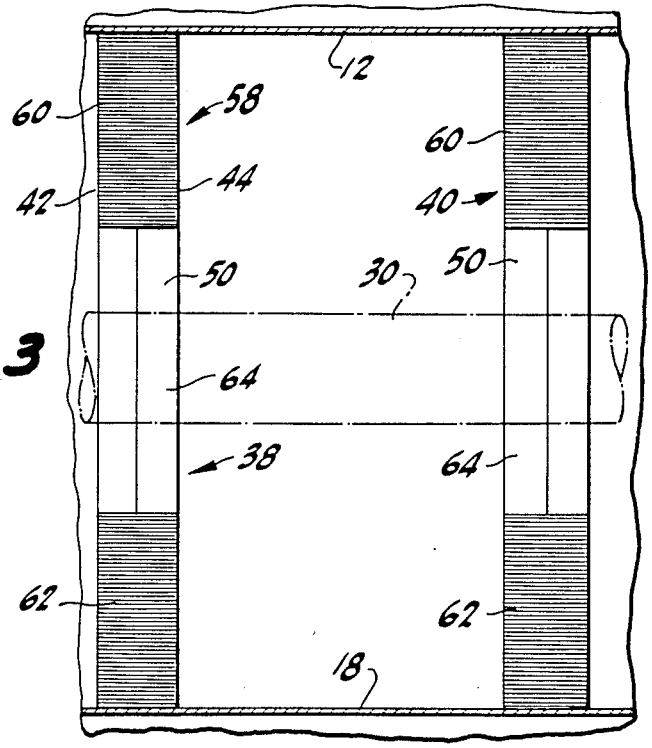
FIG-3
FIG-4
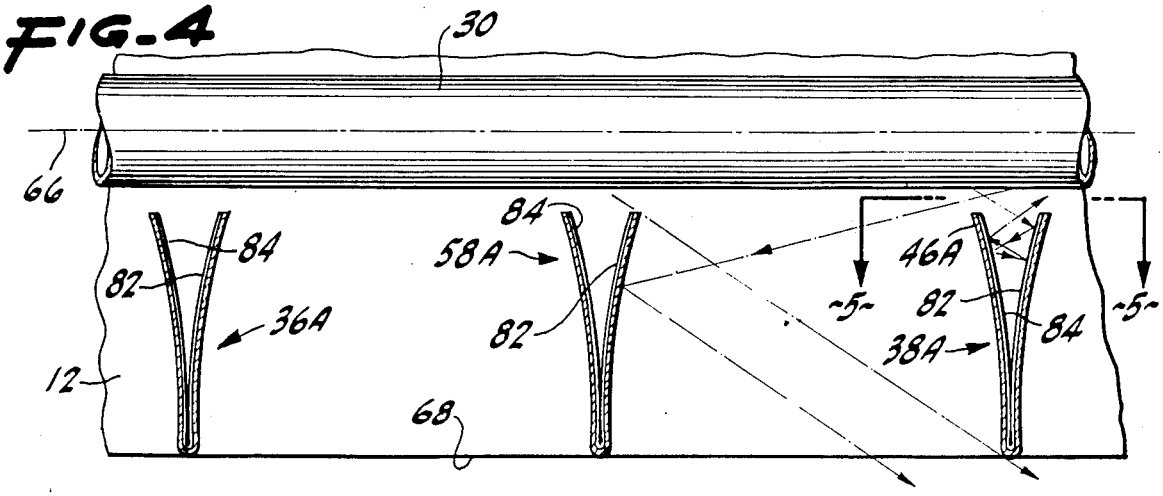

REFLECTOR SYSTEM FOR A LUMINAIRE

BACKGROUND OF THE INVENTION

The present invention relates to a novel luminaire, having reduced bright images, which is particularly compatible with video display terminals.

Fluorescent lighting fixtures are normally recessed and are typically employed for interior lighting. Reflector systems for existing lights are normally parabolic reflectors combined with cross baffles having reflecting surfaces to form "egg crate" reflector systems. For example, U.S. Pat. No. 4,494,175 describes a louver system for a recessed fluorescent lighting system of this type.

U.S. Pat. No. 3,124,310 shows a lighting fixture louver which may be constructed of transparent or translucent materials. Various color effects are obtained in this manner by employing colored plastic and colored matelic coatings.

U.S. Pat. Nos. 858,968 and 4,006,355 show the use of thin baffles which use side portions having darkened areas to reduce glare, thereby.

A problem exists with low-brightness specular parabloic luminaires in that bright spots appear above the cut-off angle of such luminaires. Such bright spots are reflected in video display screens, which can obscure characters on the video display screen. The user of the video display terminal may also experience dual-focusing between the reflected image and the character on the video display screen. In the past, the recessed lighting fixtures have been spaced further apart requiring brighter lamps to maintain the proper lighting levels in the space occupied by the video display terminals.

A luminaire which efficiently illuminates a space having video display terminals without bright-spot glare would be a great advance in the lighting field.

SUMMARY OF THE INVENTION

In accordance with the present invention a novel and useful reflector system for a luminaire compatible with video display systems is provided.

Reflector system of the present invention is employed with an electric lamp, which may be of the fluorescent type supported by housing. The housing possesses an opening for permitting egress of the light emanating from the electric lamp. The system also includes first and second reflectors which extend along either side of the electric lamp and generally extend to a point above the electric lamp to a point below the electric lamp. Where the electric lamp is an elongated flourescent lamp, the first and second reflectors would bracket such a lamp in a generally parallel manner. The first and second reflectors each possess reflecting surfaces which may be of parabolic configuration. Such first and second reflectors extend inwardly relative to the housing opening.

The reflector system also includes a cross baffle located between the first and second reflectors. In many cases the cross baffle will span the first and second reflectors and have first and second reflecting surfaces for directing light generated by the electric lamp to the area being illuminated. The cross baffle extends inwardly relative to the housing opening, but to a lesser extent than the first and second reflectors. The cross baffle includes first and second end portions, the first end portion being found within the housing and the second end portion being found in the vicinity of the housing opening. The first and second reflectors, as well as the cross baffle, are supported to the housing.

The present may also be deemed to include means for absorbing light generated by the electric lamp at the first end portion of the cross baffle. Such light absorbtion prevents the reflection of an image of the electric lamp from the first end portion of the cross baffle, i.e.: a bright spot. Such light absorbing means may take the form of darkening a portion or portions of the cross baffle adjacent the first and second reflectors. In addition, such light absorbing means may take the form of a cavity notched into the cross baffle. Such cavity may likewise be formed as a pair of cavities lying adjacent the first and second reflectors in essentially the same position as, and in substitution for, the darkened areas of the cross baffle. Such cavity or cavities may further include a darkened interior, a "blackbox". A reflecting surface may interpose the darkened areas or cavities of the cross baffle, as the case may be. A mulitplicity of such cross baffles may be provided to span the first and second reflectors and form an "egg crate" configuration.

It may be apparent that a novel and useful reflector system for a luminaire is provided.

It is an object of the present invention to provide a reflector system for a luminaire which illuminates an area and is compatible with video display terminals in that area.

It is another object of the present invention to provide a reflector system for a luminaire which eliminates double focusing by an operator viewing a video display terminal screen.

Another object of the present invention is to provide a reflector system for a luminaire that does not possess "bright spots" above the cut-off angle of light projected from the luminaire.

Yet another object of the present invention is to provide a reflector system for a luminaire which is relatively simple to manufacture.

The invention possesses other objects and advantages especially as concerns particular characteristics and features thereof which will become apparent as the specification continues.

BRIEF DESCRIPTION OF THE DRAWINGS

FIG. 2 is a view taken along line 2—2 of FIG. 1.

FIG. 3 is a view taken along line 3—3 of FIG. 2.

FIG. 4 is a sectional view, simular to FIG. 2, showing another embodiment of the cross baffles of the present invention.

FIG. 5 is a sectional view taken along line 5—5 of FIG. 4.

Figure 1:
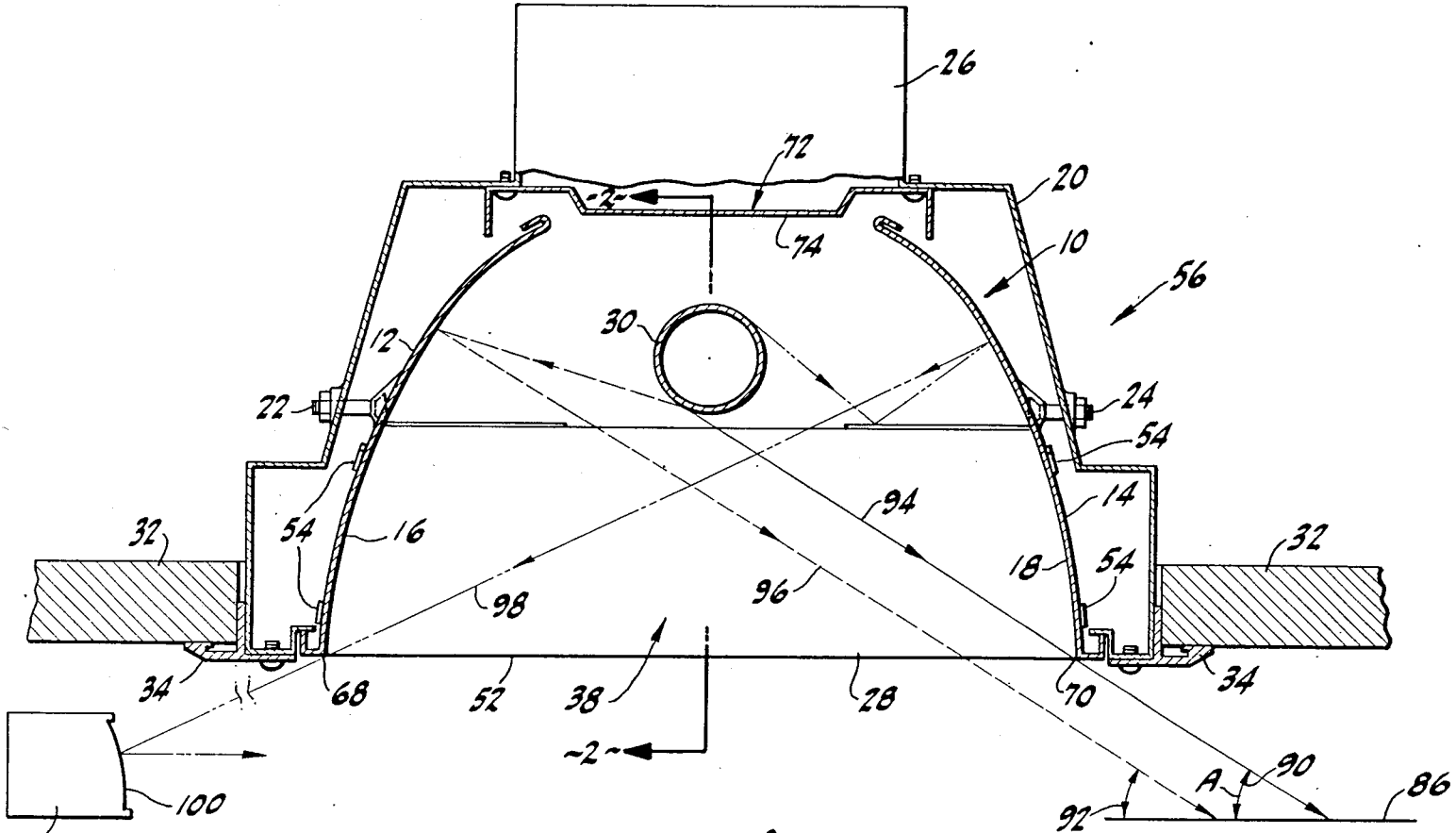
FIG. 1 is a sectional view of the luminaire reflector system of the present invention with typical ray lines shown during use.

For better understanding of the invention reference is made to the following detailed description of the preferred embodiments of the invention which will become apparent as the specification continues.

DESCRIPTION OF THE PREFERRED EMBODIMENTS

Various aspects of the present invention will evolve from the following detailed description of the preferred embodiments thereof which should be referenced to the prior described drawings.

The invention as a whole is shown in the drawings by reference character 10. The reflector system 10 includes as one of its elements first and second reflectors or stringers 12 and 14. The stringers 12 and 14 have identical curved reflecting surfaces 16 and 18, respectively, however reflecting surfaces 16 and 18 may possess different contours in certain cases. Stringers 12 and 14 are fixed to housing 20 by fastening means 22 and 24, which may take the form of set screws, nuts and bolts, and the like. Housing 20 includes a compartment 26 for electrical components such as conductors, junction boxes, ballasts, and the like. Housing 20 terminates in an opening 28 which permits light to emanate from lamp 30, illustrated to represent an elongated flourescent lamp. Lamp 30 electrically and mechanically couples with socket 32, in the conventional manner, FIG. 2.

Housing 20 is mounted to a structure within exterior surface material 32, such as a wall, ceiling, or the like. Trim piece 34 is employed to cover the junction between housing 20 and surface material 32.

System 10 also includes a multiplicity of cross baffles 36, FIGS. 2–4, which span stringers 12 and 14. Exemplar baffle 38 is virtually identical to baffle 40 and others (not shown) along the length of lamp 30. Baffle 38 includes first reflecting surface 42 and second reflecting surface 44. Baffle 38 forms a first end portion 46 and a second end portion 48. First end portion 46 is positioned within housing 20 and terminates in an end surface 50. Second end portion 48 of baffle 38 includes an end or edge 52. Baffle 38 connects to first and second stringers 12 and 14 by the use of bendable plurality of tabs 54, FIG. 1. Cross baffle 40 and other cross baffles (not shown) of multiplicity of cross baffles 36 are constructed in a similar manner to cross baffle 38.

End surface 50 of cross baffle 38 aids in the generation "bright spots" from luminaire 56. System 10 is also provided with means 58 for absorbing light generated by lamp 30 at first end portion 46 of cross baffle 38. Specifically, light is absorbed at end surface 50. Means 58 may take the form of darkened areas 60 and 62 of end surface 50. Specular surface 64 interposes darkened surface areas 60 and 62. Specular surface 64 reflects light from source 30 at angles greater than shielding angle A i.e.: measured from horizontal surface 86. Darkened areas 60 and 62 may be formed by painting, coating, cladding, dark material or the like on areas 60 and 62 of end surface 50. Such darkening would be to the extent that an image of electric lamp 30 would not be visible below luminaire 56 as a result of light striking darkened areas 60 and 62.

It should be noted that first and second stringers 12 and 14 extend inwardly from opening 28 from housing 20. Likewise, plurality of baffles 36 also extend inwardly from opening 28, but to a lesser degree, below the axis 66 lamp 30. First and second stringers 12 and 14 terminate in edges 68 and 70. Edge 52 of cross baffle 38, as well as other edges of the multiplicity of cross baffles 36, and edges 68 and 70 of stringers 12 serve to cut off the maximum angle of light shining directly from lamp 30 or reflected by system 10. It should be noted that light directed above lamp 30 is intercepted by overhead reflector 72 having a reflecting surface 74.

Turning to FIG. 4 it may be seen that means 58A is also depicted for absorbing light at the first end portion 46A of cross baffle 38A. A multiplicity of cross baffles 36A constructed similarly to cross baffle 38A may also be included. Means 58A may take the form of cavities 76 and 78 interposed by the specular surface 80 at end portion 46A of cross baffle 38A. Cavities interiors 76 and 78 may be constructed with coatings 82 and 84, respectively, of darkened material. Thus, light is captured by the "blackbox" construction of cavities 76 and 78. The remaining multiplicity of cross baffles 36A are constructed similarly to cross baffle 38A, FIGS. 4 and 5.

In operation, light would shine directly from lamp 30 onto area 86 as well as video display terminal 88, shown schematically in FIG. 1. Edge portions 68 and 70 of stringers 12 and 14 as well as edge 52 of cross baffle 38, and similar edges of multiplicity of cross baffles 36, serve as a glare cut-off at shielding angle A (measured from horizontal surface 86) depicted by directional arrows 90 and 92. Angle A in certain instances may be set at approximately 32 degrees, although other angles may be predetermined in this regard. Ray 94, FIG. 1, represents the maximum angle of light shining directly from lamp 30 which may exit luminaire 56 through opening 28. Ray 96 represents another maximum angle light ray which is reflected from stringer 12 before passing through opening 28 of luminaire 56. Ray 98 represents a "bright spot" ray which emanates from lamp 30, is reflected by top surface 50 of cross baffle 38, is reflected by stringer 14 and passes through opening 28 at an angle less than angle A. Ray 98 is eliminated by means 58 and/or 58A which absorbs such light rays. Thus, luminaire 56 may be used with video display terminal 88 where screen 100 thereof is positioned outside the reach of maximum angle rays, such as ray 94, which would reflect into the eyes of the user of video display terminal 88.

While in the foregoing embodiments of the present invention have been set forth in considerable detail for the purposes of making a complete disclosure of the invention, it may be apparent to those of skill in the art that numerous changes may be made in such details without departing from the spirit and principles of the invention.

What is claimed is:

1. A reflector system for a luminaire employing an electric lamp for illuminating an area and supported by a housing having an opening for permitting egress of light therefrom comprising:

a. a first reflector extending along one side of the electric lamp, said first reflector including a reflecting surface for directing light generated by the electric lamp to the area, said first reflector further extending inwardly relative to the housing opening;

b. a second reflector extending along another side of the electric lamp, said second reflector including a reflecting surface for directing light generated by the electric lamp to the area, said second reflector further extending inwardly relative to the housing opening;

c. a cross baffle located between said first and second reflectors, said cross baffle including a first reflecting surface for directing light generated by the electric lamp to the area, a second reflecting surface for directing light generated by the electric lamp to the area, said first and second reflecting surfaces of said cross baffle extending inwardly relative to the housing opening, said cross baffle further including a first end portion between said first and second reflecting surfaces of said cross baffle, said end portion being positioned within the housing and a second end portion between said first and second reflecting surfaces in the vicinity of the housing opening;

d. means for absorbing light generated by the electric lamp of said first end portion of said cross baffle to prevent reflecting of an image of the electric lamp from said first end portion of said cross baffle, said light absorbing means including a first and second cavity open at said first end portion of said cross baffle, said first cavity lying adjacent said first reflector, said second cavity lying adjacent said second reflector; and e. means for supporting said, first and second reflectors and said cross baffle to the housing.

2. The system of claim 1 in which said first end portion of said cross baffle includes a reflecting end surface interposed said first and second cavities.

3. The system of claim 1 in which said first and second cavities each includes a darkened interior surface.

4. The system of claim 1 in which said first and second reflectors extend further inwardly relative to the housing opening than said cross baffle.

5. The system of claim 1 in which said reflecting surfaces of said first and second reflectors possess a parabolic shape.

6. The system of claim 1 in which said cross baffle is a first cross baffle and which further comprises a second cross baffle spaced from said first cross baffle and located between said first and second reflectors.

7. the system of claim 2 in which said first and second cavities each includes a darkened interior surface.

* * * * *